US007121984B1

(12) United States Patent
Hong

(10) Patent No.: US 7,121,984 B1
(45) Date of Patent: Oct. 17, 2006

(54) CONVERTIBLE STEPPING EXERCISER

(76) Inventor: Chou Hong, No. 17, Renhe Road, Nangang Industrial Zone, Nantou City, Nantou Hsien 54065 (TW)

( * ) Notice: Subject to any disclaimer, the term of this patent is extended or adjusted under 35 U.S.C. 154(b) by 0 days.

(21) Appl. No.: 11/168,892

(22) Filed: Jun. 27, 2005

(51) Int. Cl.
*A63B 22/04* (2006.01)
*A63B 22/06* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 5,779,599 | A | 7/1998 | Chen | 482/57 |
| 5,938,569 | A | 8/1999 | Lin | 482/52 |
| 6,080,086 | A | 6/2000 | Maresh et al. | 482/57 |
| 6,450,925 | B1 | 9/2002 | Kuo | 482/52 |
| 6,575,877 | B1 * | 6/2003 | Rufino et al. | 482/51 |
| 6,908,416 | B1 * | 6/2005 | Mercado et al. | 482/52 |
| 6,994,656 | B1 * | 2/2006 | Liao et al. | 482/52 |
| 7,025,710 | B1 * | 4/2006 | Corbalis et al. | 482/52 |
| 7,041,036 | B1 * | 5/2006 | Kuo | 482/52 |

* cited by examiner

*Primary Examiner*—Stephen R. Crow
(74) *Attorney, Agent, or Firm*—Charles E. Baxley

(57) ABSTRACT

A convertible exerciser includes a post extended from a base, a pair of cranks rotatably attached to the base, a pair of handles rotatably attached to the post of the base, a pair of levers slidably engaged on the free end portions of the cranks and each having a front portion pivotally coupled to the handles to allow the levers to be movably coupled to the handles, and a pair of foot supports slidably engaged on the levers. The front portions of the foot supports may be selectively coupled to the handles to conduct an elliptical exercise, or selectively coupled to the post of the base, to conduct a stepping exercise, to allow the users to conduct different kinds of exercises with a single convertible exerciser.

9 Claims, 7 Drawing Sheets

CONVERTIBLE STEPPING EXERCISER

BACKGROUND OF THE INVENTION

1. Field of the Invention

The present invention relates to an exerciser, and more particularly to an exerciser convertible between an elliptical exerciser and a stepping exerciser.

2. Description of the Prior Art

Typical exercisers, such as stepping exercisers have been widely developed and used today, and comprise a pair of foot pedals including one end pivotally or rotatably attached to a base, to allowing the foot pedals to be stepped downwardly and moved upwardly relative to the base by the users.

For example, U.S. Pat. No. 5,938,569 to Lin discloses one of the typical stepping exercisers also comprising a pair of foot pedals including a front end pivotally or rotatably attached to a base, to allowing the users to conduct stepping exercises. The foot pedals of the typical stepping exercisers should include one end pivotally or rotatably attached to the base, such that the typical stepping exercisers may not be changed or converted to the other exercisers, such as the elliptical exercisers.

U.S. Pat. No. 5,779,599 to Chen, and U.S. Pat. No. 6,080,086 to Maresh et al., and U.S. Pat. No. 6,450,925 to Kuo disclose three of typical elliptical exercisers, each comprising a pair of foot pedals movably supported on a base, and movable along elliptical moving paths or strokes. For allowing the foot pedals to be moved along the elliptical moving paths or strokes, the foot pedals may not be solidly secured or attached to the base, such that the foot pedals of the typical elliptical exercisers may not be changed or converted to the other exercisers, such as the stepping exercisers, and such that the users have to purchase a typical stepping exerciser to conduct the typical stepping exercises, and have to purchase another typical elliptical exerciser to conduct the typical elliptical exercises.

The present invention has arisen to mitigate and/or obviate the afore-described disadvantages of the conventional convertible exercisers.

SUMMARY OF THE INVENTION

The primary objective of the present invention is to provide a convertible exerciser including a structure convertible between an elliptical exerciser and a stepping exerciser, for allowing the users to conduct different kinds of exercises with a single convertible exerciser.

In accordance with one aspect of the invention, there is provided a convertible exerciser comprising a base including a post extended upwardly therefrom, a pair of cranks rotatably attached to the base, and each including a free end portion, a pair of handles rotatably attached to the post of the base, to allow the handles to be rotated or swung relative to the post of the base, and each including a lower portion, a pair of levers slidably engaged onto and supported on the free end portions of the cranks respectively, and each including a front portion pivotally coupled to the lower portions of the handles respectively, to allow the levers to be movably coupled to the handles and to be moved by the handles respectively, and a pair of foot supports slidably engaged onto and supported on the levers respectively, and each including a front portion. The front portions of the foot supports may be selectively coupleable to the lower portions of the handles respectively, to selectively couple the foot supports to the handles respectively, and to allow the foot supports to be moved along elliptical moving strokes and thus to selectively conduct an elliptical exercise, and the front portions of the foot supports may also be selectively coupleable to the post of the base, to allow the foot supports to be stepped relative to the base by a user in a reciprocating action, to conduct a stepping exercise, and thus for allowing the users to conduct different kinds of exercises with a single convertible exerciser.

The foot supports each includes a coupler attached to the front portion thereof respectively, and the coupler is selectively coupleable to the lower portion of the handle, and selectively coupleable to the post of the base. The couplers each includes a bracket attached to the front portions of the foot supports respectively, and a stud extended from the bracket, for selectively coupling to either the lower portion of the handle or the post of the base.

The handles each includes a bracket attached to the lower portion thereof, and the levers each includes a front portion pivotally attached to the bracket of the handle, to movably couple the levers to the handles respectively. The front portions of the levers are curved front portions.

The cranks each includes a roller attached to the free end portion thereof, and the levers are slidably engaged onto and supported on the rollers of the cranks respectively. The foot supports each includes a wheel rotatably attached thereto, for slidably or movably engaged and supported on the levers respectively.

The base includes an axle attached to the post and two brackets attached to ends of the axle, for selectively coupling to the front portions of the foot supports. The brackets each may include either a semi-cylindrical structure or a cylindrical structure.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
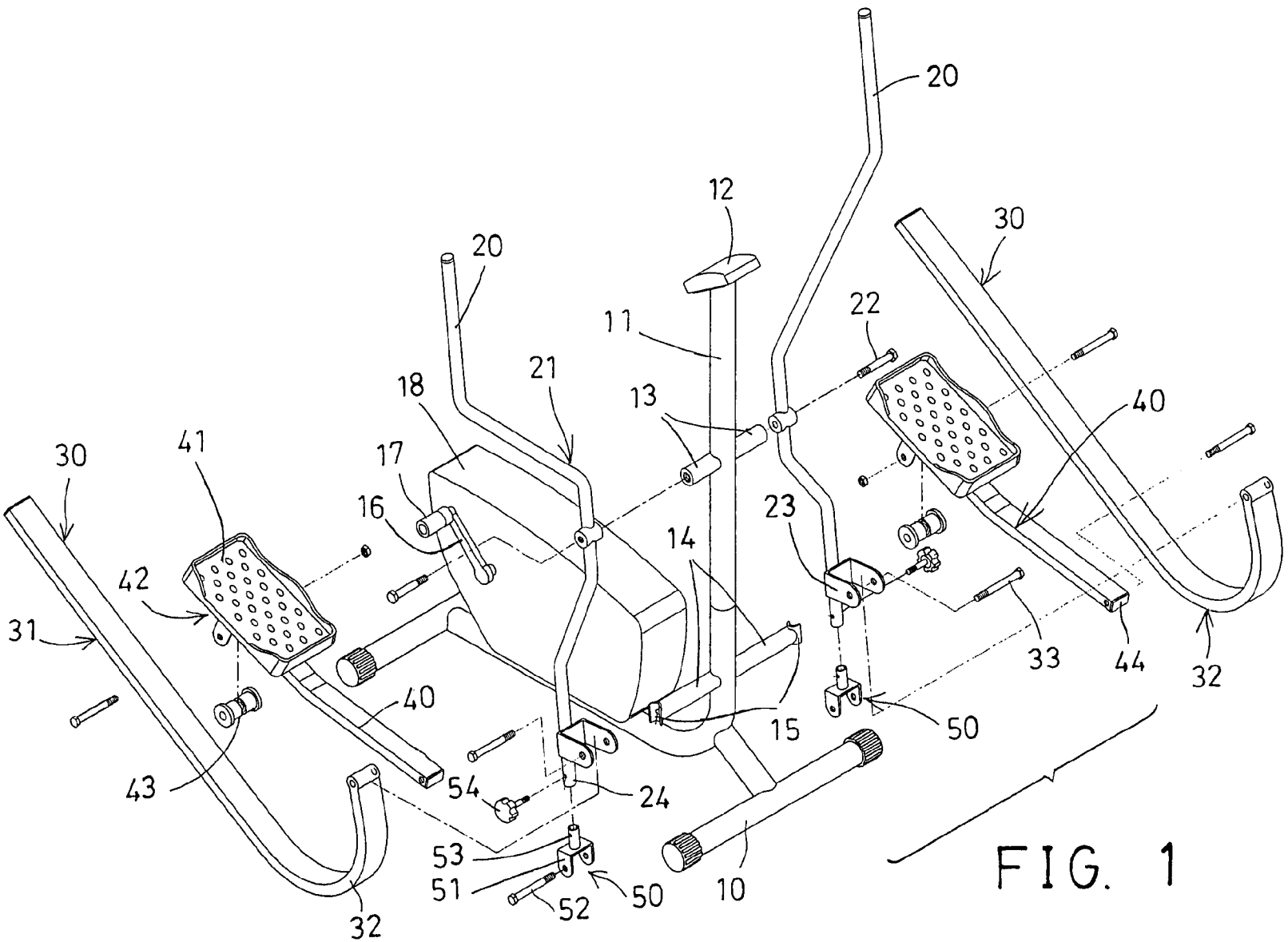
FIG. 1 is an exploded view of a convertible exerciser in accordance with the present invention.
Figure 2:
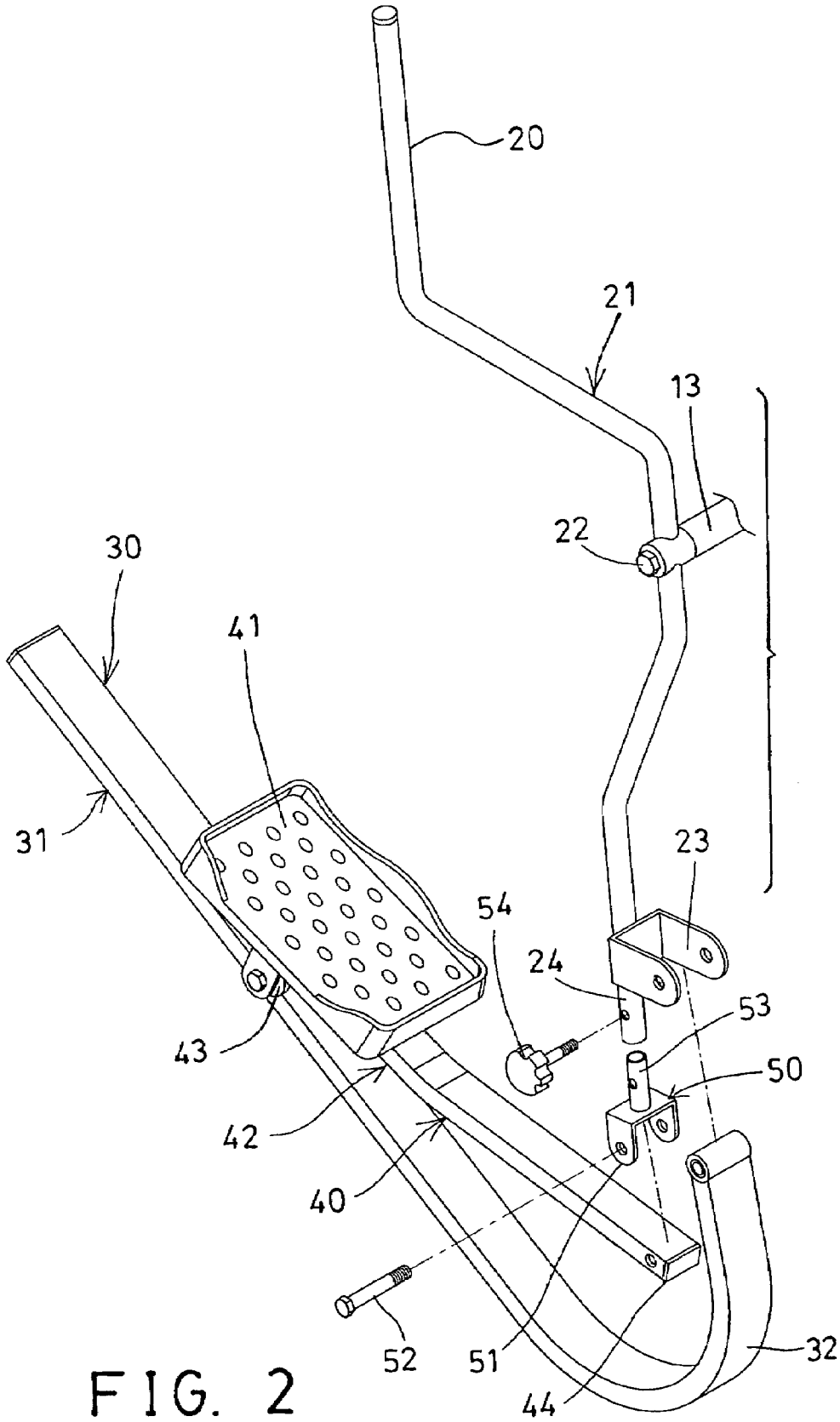
FIG. 2 is a partial exploded view of the convertible exerciser.

Referring to the drawings, and initially to FIGS. 1–4, a convertible exerciser in accordance with the present invention comprises a base 10 including a post 11 extended upwardly therefrom, such as extended upwardly from the front portion or middle portion thereof, and including a meter or a control panel or control device 12 provided and disposed on top of the post 11, and including a shaft 13 attached to or extended from the upper portion or middle portion of the post 11, and laterally extended out of the two side portions of the post 11.

The base 10 further includes an axle 14 attached to or extended from the lower portion or middle portion of the post 11, and also laterally extended out of the two side portions of the post 11, and includes two brackets 15 attached to the two ends of the axle 14, each of the brackets 15 includes a substantially semi-cylindrical shape or structure. The base 10 further includes a pair of cranks 16 rotatably attached to or extended from the base 10, and each having a roller 17 attached to a free end portion thereof, and a housing 18 attached to the base 10, for enclosing and shielding and protecting the other parts or elements.

A pair of handles 20 each includes a middle portion 21 pivotally or rotatably attached to the base 10, or to the shaft 13 of the post 11 of the base 10 with pivot pins 22, to allow the handles 20 to be rotated or swung relative to the post 11 of the base 10 with or about the shaft 13; and each includes a bracket 23 secured or attached to the lower portion 24 thereof. The upper portions of the handles 20 are provided for being grasped or held by the users, particularly while operating the exerciser.

A pair of levers 30 each includes a rear portion or middle portion 31 movably or slidably engaged onto or supported on the end portions or the rollers 17 of the cranks 16 respectively, and each includes a curved front portion 32 having a free end portion pivotally or rotatably attached to the lower portions 24 or the brackets 23 of the handles 20 with a fastener or pivot pin 33 respectively, to allow the levers 30 to be movably coupled to the handles 20 respectively and to be moved by the handles 20 respectively.

A pair of foot supports 40 each includes a foot pedal 41 disposed or supported on a rear portion or middle portion 42 thereof, for supporting the users thereon, and each includes a roller or wheel 43 rotatably attached to the rear portion or middle portion 42 thereof, and movably or slidably engaged onto or supported on the rear portions or middle portions 31 of the levers 30 respectively, and each includes a front portion 44 pivotally or rotatably attached to or coupled to the lower portions 24 of the handles 20 with a coupler 50 respectively.

For example, the couplers 50 each includes a bracket 51 for pivotally or rotatably attached to or coupled to the front portions 44 of the foot supports 40 with a pivot pole 52 respectively, and each includes a stud 53 extended from the bracket 51, for selectively engaging into the lower portions 24 of the handles 20 respectively (FIGS. 2–4), and for securing to the lower portions 24 of the handles 20 with a fastener 54 respectively, in order to pivotally or rotatably attach or couple the front portions 44 of the foot supports 40 to the lower portions 24 of the handles 20 respectively.

Figures 3, 4:
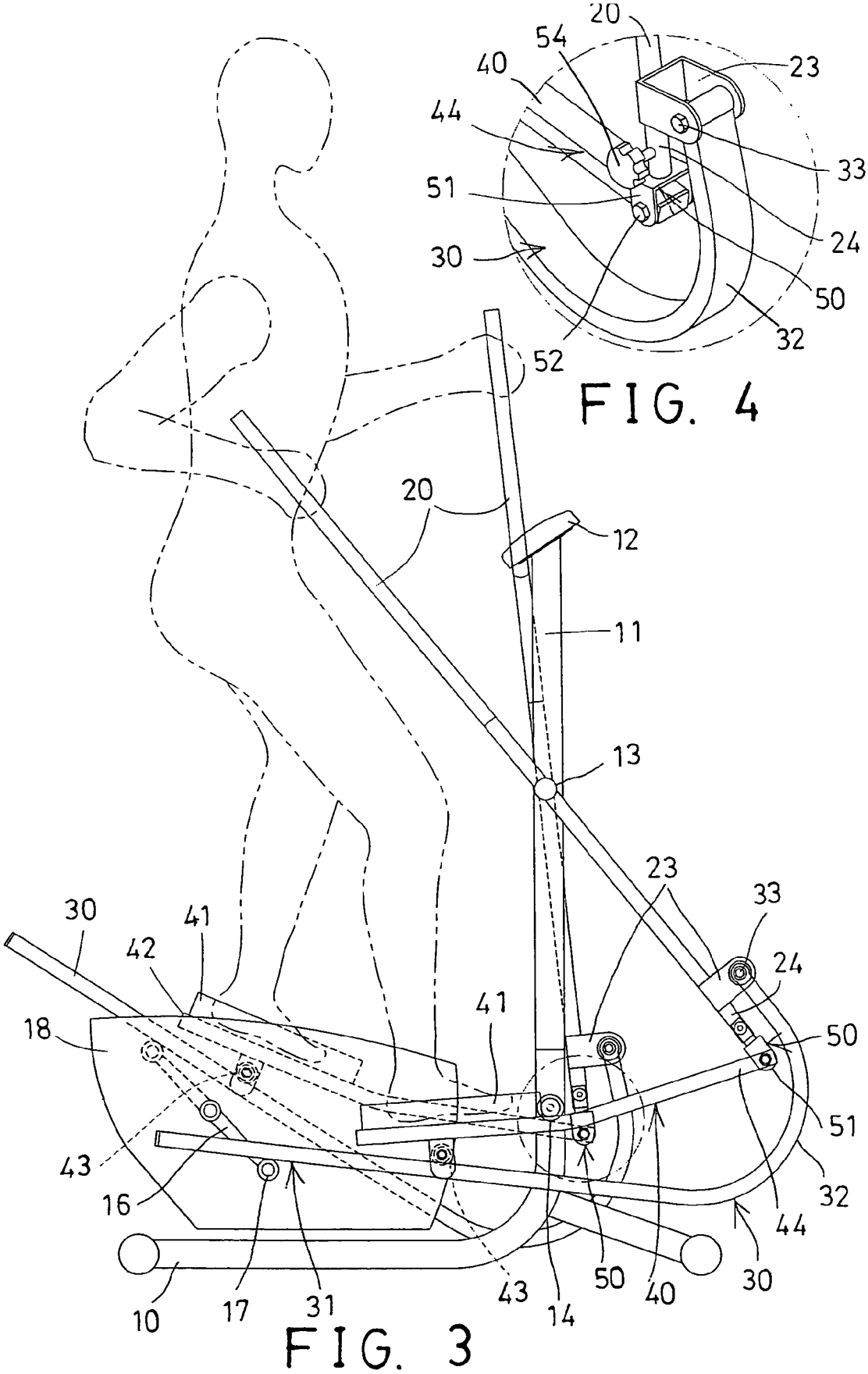
FIG. 3 is a side plan schematic view of the convertible exerciser.
FIG. 4 is an enlarged partial perspective view of the convertible exerciser.
Figure 5:
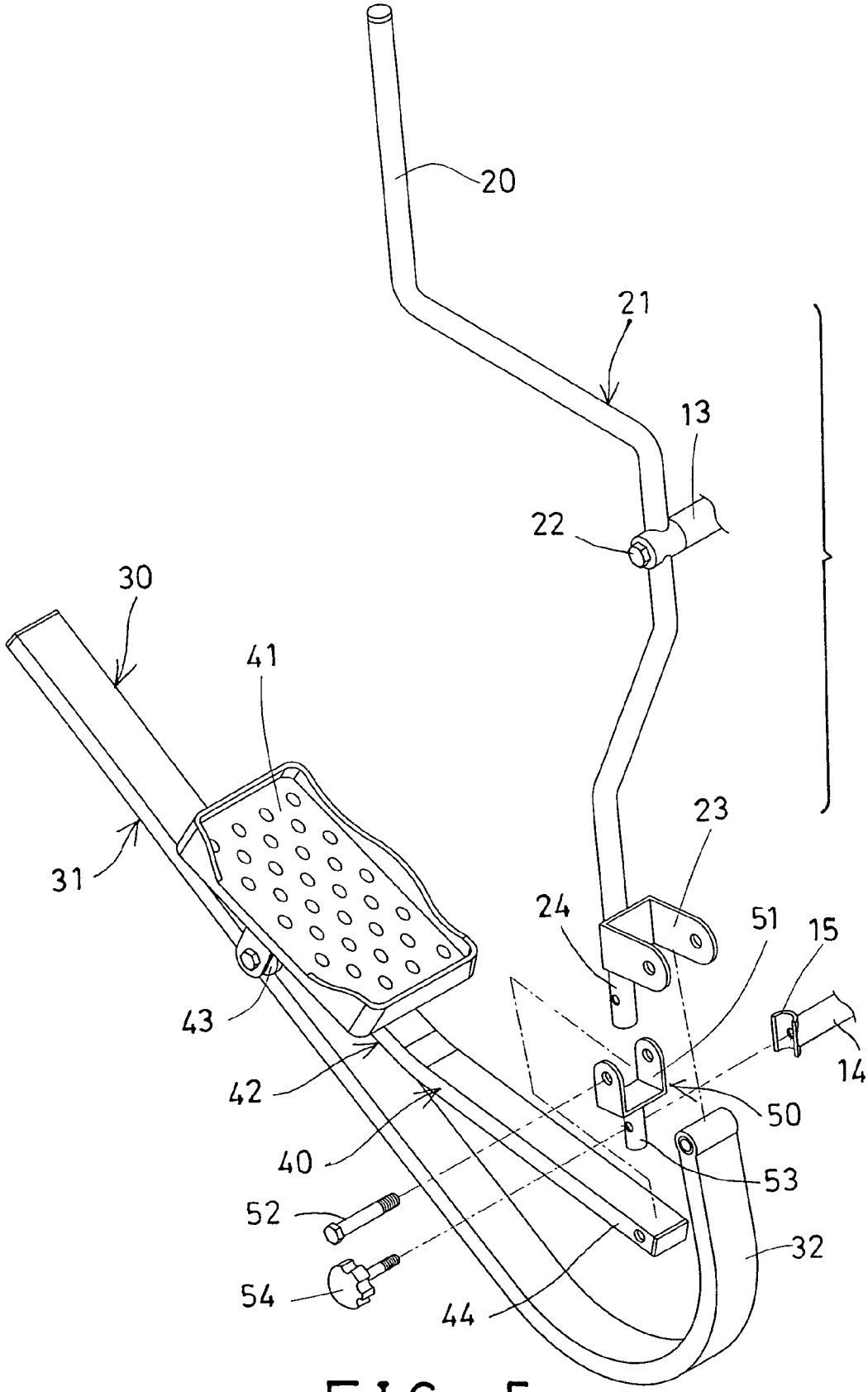
FIG. 5 is another partial exploded view illustrating the other arrangement and the operation of the convertible exerciser.

In operation, as shown in FIG. 3, the users may step the foot pedals 41 of the foot supports 40, and/or to pull and to push the handles 20 respectively, in order to swing or to rotate the handles 20, and thus to move the foot pedals 41 of the foot supports 40 along elliptical moving strokes, for allowing the users to conduct elliptical exercises.

Alternatively, as shown in FIGS. 5–8, the studs 53 of the couplers 50 may be disengaged from the lower portions 24 of the handles 20 by unthreading or disengaging the fasteners 54 from the lower portions 24 of the handles 20 and from the studs 53 of the couplers 50 respectively, and the couplers 50 may be rotated relative to the foot supports 40 for about 180 degrees, or may be rotated downwardly relative to the foot supports 40, and may then be attached to or engaged with the brackets 15 of the axle 14 of the base 10, and then secured to the axle 14 of the base 10 with such as the fasteners 54.

Figures 6, 8:
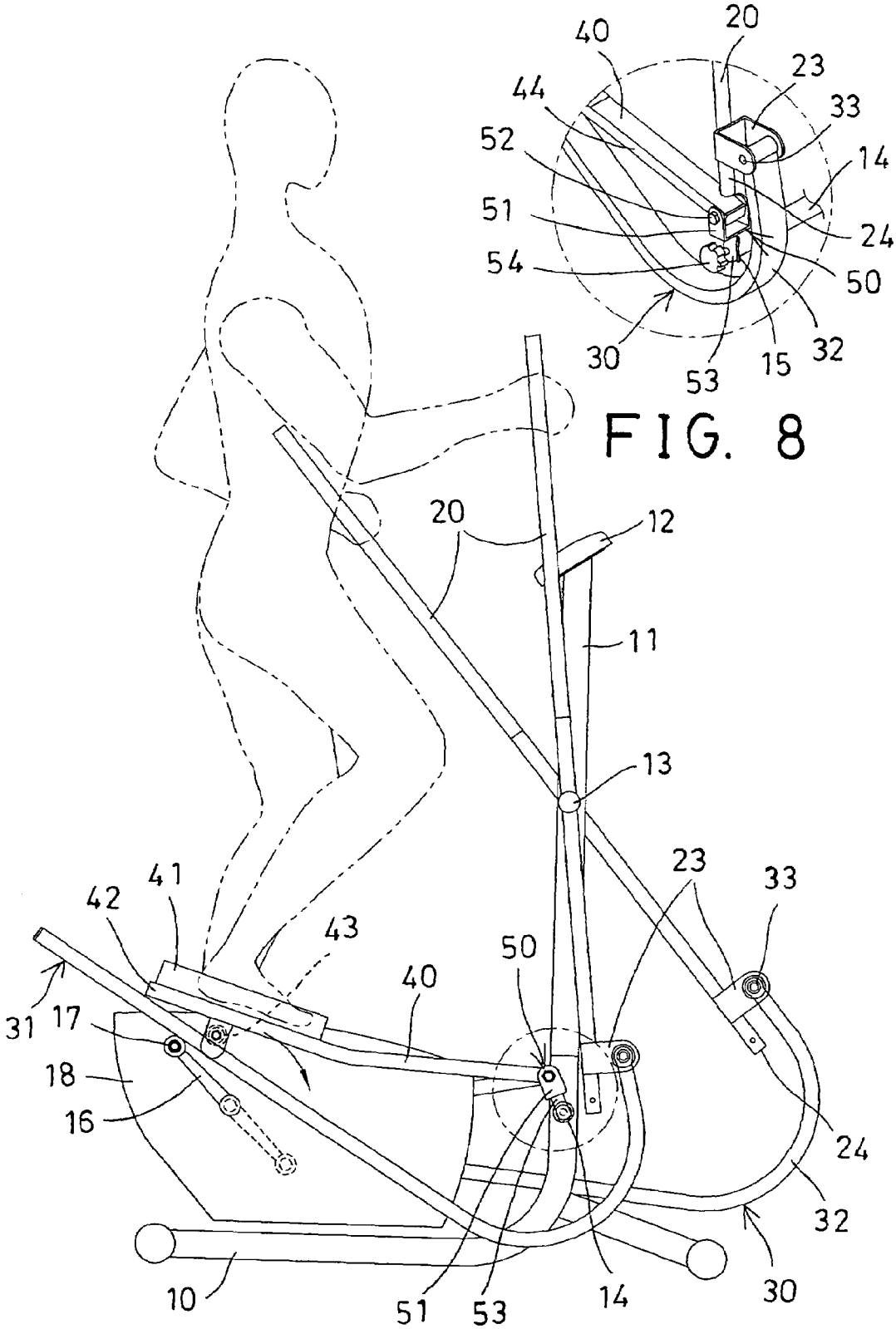
FIG. 6 is a side plan schematic view illustrating the arrangement of the convertible exerciser as shown in FIG. 5.
FIG. 8 is an enlarged partial perspective view of the convertible exerciser as shown in FIGS. 5–7.
Figure 7:
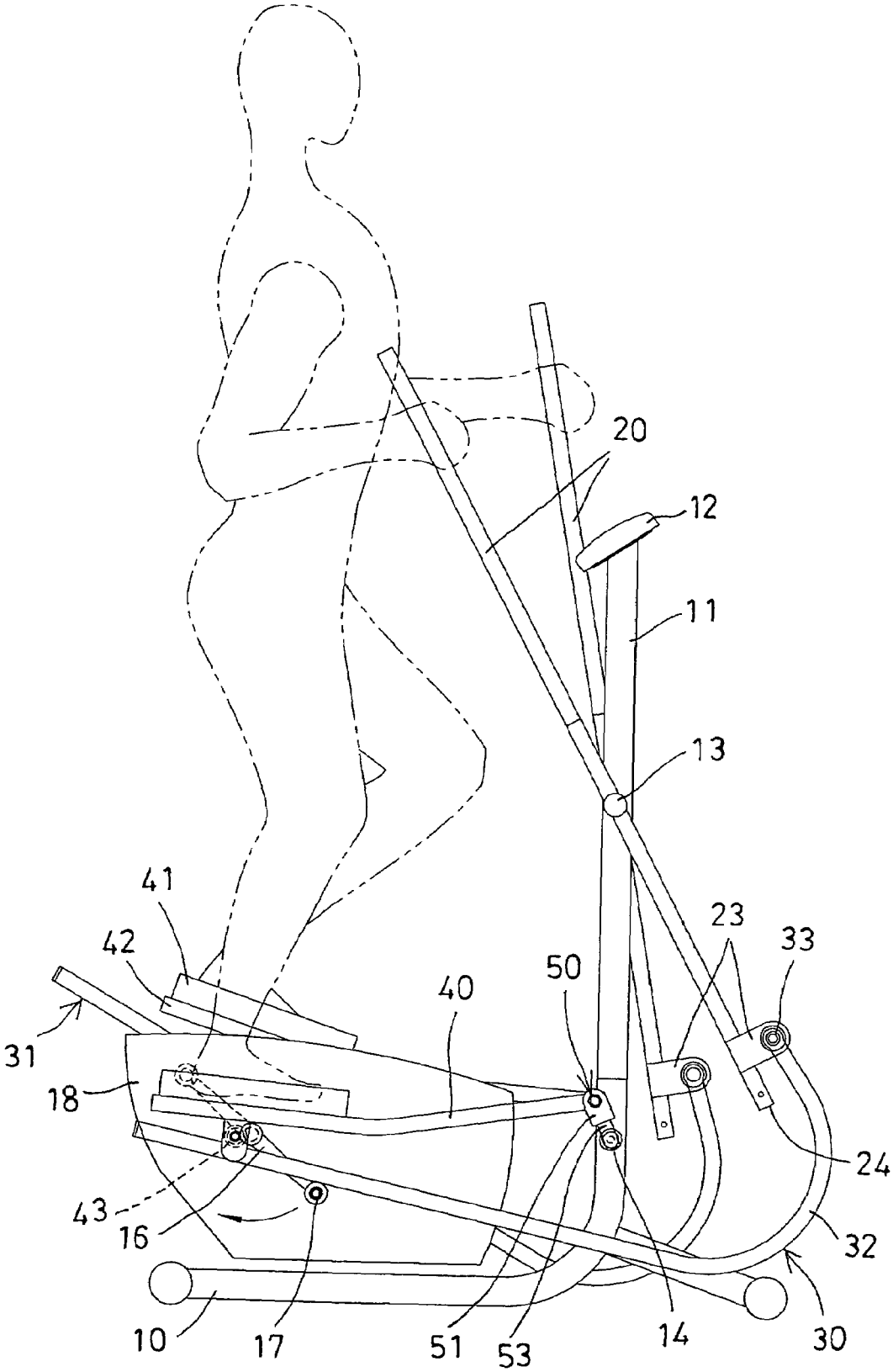
FIG. 7 is a side plan schematic view similar to FIG. 6, illustrating the operation of the convertible exerciser as shown in FIGS. 5–6.

In operation, as shown in FIGS. 6 and 7, the front portions 44 of the foot supports 40 may be pivotally or rotatably couple to the post 11 of the base 10, to allow the foot supports 40 to be stepped downwardly and moved upwardly or operated relative to the base 10 by the users in a reciprocating action, to conduct the stepping exercises, such that the exerciser in accordance with the present invention is convertible between an elliptical exerciser and a stepping exerciser, to allow the users to conduct different kinds of exercises with the single convertible exerciser in accordance with the present invention.

Figure 9:
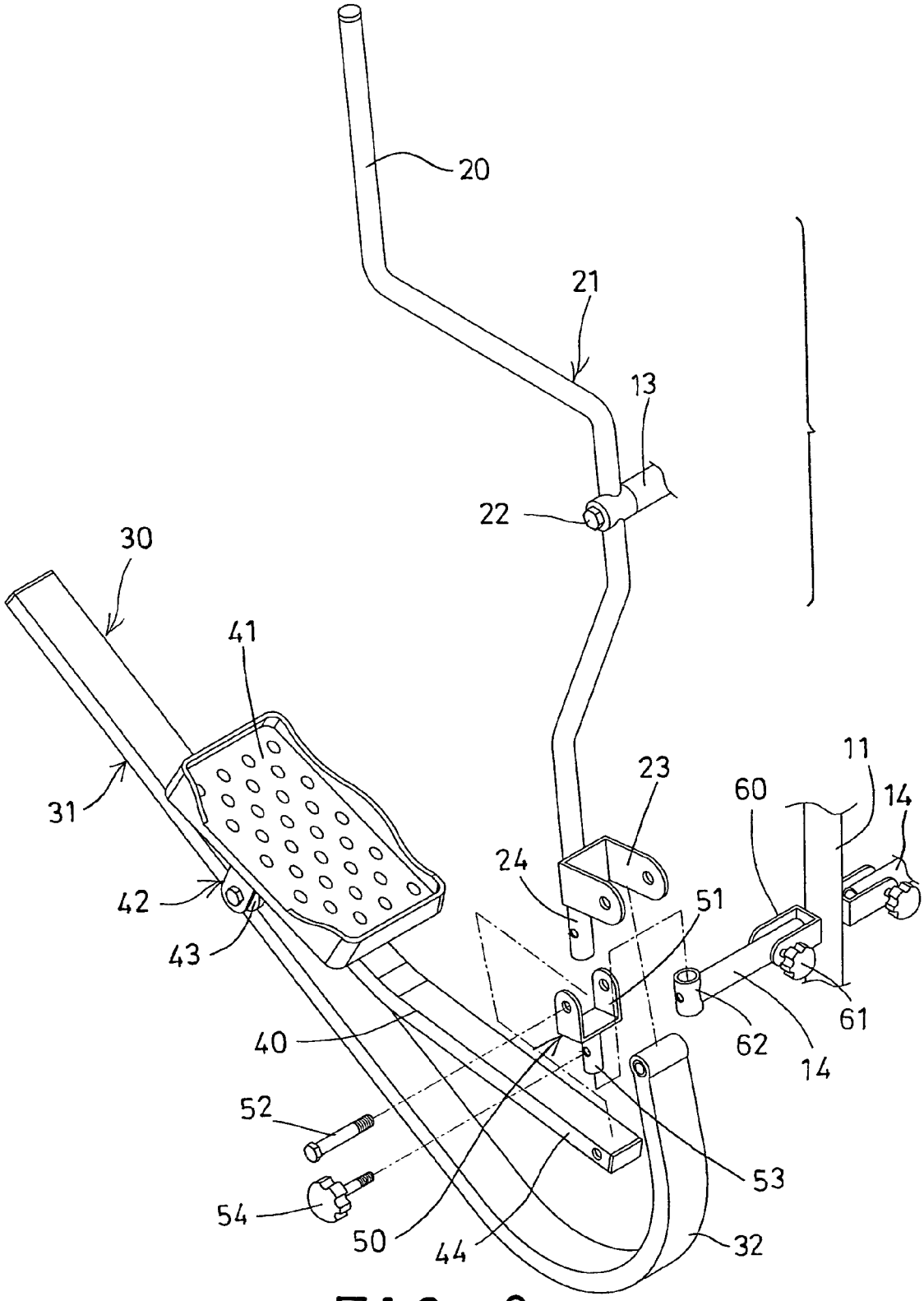
FIG. 9 is a further partial exploded view similar to FIGS. 2 and 5, illustrating the further arrangement of the convertible exerciser.

As shown in FIG. 9, alternatively, the base 10 may include two axles 14 pivotally or rotatably attached to or coupled to the post 11 with brackets 60 and fasteners 61 respectively, and may include two cylindrical tubes 62 attached to the free ends of the axles 14 respectively, to selectively receive the studs 53 of the couplers 50 respectively, and thus to solidly attach or couple the front portions 44 of the foot supports 40 to the post 11 of the base 10 respectively, and to prevent the studs 53 of the couplers 50 from being moved or rotated relative to the axles 14 respectively.

Accordingly, the convertible exerciser in accordance with the present invention includes a structure convertible between an elliptical exerciser and a stepping exerciser, for allowing the users to conduct different kinds of exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A convertible exerciser comprising:

a base including a post extended upwardly therefrom, a pair of cranks rotatably attached to said base, and each including a free end portion, a pair of handles rotatably attached to said post of said base, to allow said handles to be rotated or swung relative to said post of said base, and each including a lower portion, a pair of levers slidably engaged onto and supported on said free end portions of said cranks respectively, and each including a front portion pivotally coupled to said lower portions of said handles respectively, to allow said levers to be movably coupled to said handles and to be moved by said handles respectively, and a pair of foot supports slidably engaged onto and supported on said levers respectively, and each including a front portion, said front portions of said foot supports being selectively coupleable to said lower portions of said handles respectively, to selectively couple said foot supports to said handles respectively, and to allow said foot supports to be moved along elliptical moving strokes and thus to selectively conduct an elliptical exercise, and said front portions of said foot supports being selectively coupleable to said post of said base, to allow said foot supports to be stepped relative to said base by a user in a reciprocating action, to conduct a stepping exercise.

2. The convertible exerciser as claimed in claim 1, wherein said foot supports each includes a coupler attached to said front portion thereof respectively, and said coupler is selectively coupleable to said lower portion of said handle, and selectively coupleable to said post of said base.

3. The convertible exerciser as claimed in claim 2, wherein said couplers each includes a bracket attached to said front portions of said foot supports respectively, and a stud extended from said bracket, for selectively coupling to said lower portion of said handle and said post of said base.

4. The convertible exerciser as claimed in claim 1, wherein said handles each includes a bracket attached to said lower portion thereof, and said levers each includes a front portion pivotally attached to said bracket of said handle, to movably couple said levers to said handles respectively.

5. The convertible exerciser as claimed in claim 4, wherein said front portions of said levers are curved front portions.

6. The convertible exerciser as claimed in claim 1, wherein said cranks each includes a roller attached to said free end portion thereof, and said levers are slidably engaged onto and supported on said rollers of said cranks respectively.

7. The convertible exerciser as claimed in claim 1, wherein said foot supports each includes a wheel rotatably attached thereto, and movably engaged and supported on said levers respectively.

8. The convertible exerciser as claimed in claim 1, wherein said base includes an axle attached to said post and two brackets attached to ends of said axle, for selectively coupling to said front portions of said foot supports.

9. The convertible exerciser as claimed in claim 8, wherein said brackets each includes a semi-cylindrical structure.

* * * * *